US009586250B2

(12) United States Patent
Fockedey et al.

(10) Patent No.: US 9,586,250 B2
(45) Date of Patent: Mar. 7, 2017

(54) TANDEM ROLLING MILL OUTPUT METHOD AND INSTALLATION WITH COILING CAROUSEL COUPLED WITH ON-LINE INSPECTION

(71) Applicant: Cockerill Maintenance & Ingénierie S.A., Seraing (BE)

(72) Inventors: Emilie Fockedey, Marbais (BE); Andreas Köppe, Unna (DE)

(73) Assignee: Cockerill Maintenance & Ingénierie S.A., Seraing (BE)

( * ) Notice: Subject to any disclaimer, the term of this patent is extended or adjusted under 35 U.S.C. 154(b) by 162 days.

(21) Appl. No.: 14/377,068

(22) PCT Filed: Jan. 17, 2013

(86) PCT No.: PCT/EP2013/050835

§ 371 (c)(1),
(2) Date: Aug. 6, 2014

(87) PCT Pub. No.: WO2013/117400

PCT Pub. Date: Aug. 15, 2013

(65) Prior Publication Data

US 2015/0014467 A1 Jan. 15, 2015

Related U.S. Application Data

(60) Provisional application No. 61/595,403, filed on Feb. 6, 2012.

(30) Foreign Application Priority Data

May 16, 2012 (EP) ..... 12168283

(51) Int. Cl.
*B21B 38/00* (2006.01)
*B21B 39/00* (2006.01)
(Continued)

(52) U.S. Cl.
CPC ..... *B21C 47/245* (2013.01); *B21C 51/00* (2013.01); *B21B 38/00* (2013.01); *B21B 39/004* (2013.01)

(58) Field of Classification Search
CPC ..... B21B 38/00; B21B 38/02; B21B 38/04; B21B 15/0007; B21B 2015/0014;
(Continued)

(56) References Cited

U.S. PATENT DOCUMENTS 5,544,408 A * 8/1996 Tippins ..... B21B 45/00 72/202
6,309,482 B1 * 10/2001 Dorricott ..... B21B 37/74 72/203
(Continued)

FOREIGN PATENT DOCUMENTS

EP 1581355 B1 8/2006
JP 2000254725 A 9/2000
(Continued)

OTHER PUBLICATIONS

Machine Translation of JP 2000-254725 A http://translationportal.epo.org/emtp/translate/?ACTION=description-retrieval&COUNTRY=JP&ENGINE=google&FORMAT=docdb&KIND=A&LOCALE=en_EP&NUMBER=2000254725&OPS=ops.epo.org/3.1&SRCLANG=ja&TRGLANG=en.*

*Primary Examiner* — Moshe Wilensky
*Assistant Examiner* — Pradeep C Battula
(74) *Attorney, Agent, or Firm* — Reinhart Boerner Van Deuren P.C.

(57) ABSTRACT

Method for coiling and on-line inspection of a continuously-rolled metal strip, involving continuous coiling on at least one mandrel of a coiling station, preferably of carousel type, wherein: the strip is cut by a shears situated before the coiling station, advances over a certain length on an insertion table so as to at least partially cover this table and is then
(Continued)

cut a second time by the shears in order to obtain a specimen; —the coiling performed on the mandrel is terminated and the coil is discharged from the coiling station; at the same time, the insertion table bearing the specimen is moved parallel to the rolling-coiling line until it lies in an inspection line comprising an inspection table; —the specimen is inspected on the inspection table so that faults can be detected; —once the specimen has left the insertion table, the latter is placed back in the rolling-coiling line.

4 Claims, 2 Drawing Sheets

(51) Int. Cl.
*B21C 51/00* (2006.01)
*B21C 47/24* (2006.01)

(58) Field of Classification Search
CPC ..... B21B 2015/0057; B21B 39/004; B21B 39/18; B21C 51/00; B21C 47/245
See application file for complete search history.

(56) References Cited

U.S. PATENT DOCUMENTS 6,568,056 B2 * 5/2003 Sclippa ..... B21B 35/04 72/203
6,931,703 B2 * 8/2005 Onodera ..... B23D 45/003 72/203

FOREIGN PATENT DOCUMENTS

WO WO 2004/060589 A1 7/2004
WO WO 2006/051239 A1 5/2006
WO WO 2009/047395 A1 4/2009

* cited by examiner

TANDEM ROLLING MILL OUTPUT METHOD AND INSTALLATION WITH COILING CAROUSEL COUPLED WITH ON-LINE INSPECTION

FIELD OF THE INVENTION

The present invention relates to an industrial installation and method within the technical field of metal strip rolling mills, in particular of the tandem type, with a continuous coiling station, having, at the end of rolling, an inspection table for the product rolled and being coiled.

TECHNOLOGICAL BACKGROUND AND STATE OF THE ART

Strip coiling by carousel tension coils, which will more simply be called carousel coiling, is well known as a system for final coiling in continuous rolling, both in a cold rolling mill and a hot rolling mill.

The coiling sequence is as follows:

- the carousel is in the receiving position with the raised belt winder around mandrel no. 1 in the lower position, the free mandrel no. 2 being in the upper position at 180°;
- once the strip is primed, the belt winder retracts and the coiling of coil no. 1 continues;
- while the coiling continues, the entire carousel rotates 180° clockwise if the strip comes from the left (otherwise in the opposite direction), which places coil no. 1 undergoing coiling in the evacuation position and the free mandrel in the receiving position for the front end of the next strip to be coiled;
- at the end of coiling of coil no. 1, the power is transferred to mandrel no. 2. Coil no. 1 is evacuated and the next coiling cycle begins.

The embodiment details of the means making up the coiling carousel such as the belt winder, the position of the mandrels, the mandrel support and evacuation device, etc. are well known by those skilled in the art.

One problem that arises is that of detecting, as early as possible in the manufacturing method, the faults that may be crippling for the rolled strip, for example faults of surface, geometry, thickness, flatness, etc. A separate inspection of the line cannot be contemplated, as it is disadvantageous in terms of lost time and hence from an economic standpoint.

Document JP 2000 254725 discloses a cold rolling installation comprising, mounted in that order on the line, a cold rolling mill, a moving shears that cuts the steel strip continuously produced by the rolling mill, a double-mandrel tension coiling apparatus, of the carousel winder type, which continuously coils the steel strip. The carousel coiler is positioned downstream from and below the passing line of the cold rolling mill, and a surface-inspection apparatus that inspects the surface of the steel strip is situated downstream on an extension of the passing line that passes above the carousel coiler. The installation is provided with orienting means to direct the strip toward the carousel winder or, alternatively, toward the surface-inspection apparatus, which are positioned outside the moving shears.

Document EP 1 581 355 discloses a method for the successive rolling and coiling of a metal strip, in particular a steel strip, on a coiling mandrel that is rotated and capable of being moved away, in which the metal strip is inspected in longitudinal portions relative to rolling anomalies. The strip specimens are produced by a drum shears located after the last rolling stand, guided and stopped "on-line" inside the rolling line above a coiling station situated below the rolling line, on an inspection table, for a free visual inspection.

The coiling station is therefore situated under the plane of the inspection table, the latter being positioned "on-line" with the rolling line. Here again, the steel strip that emerges from the last rolling stand may be guided such that a deflecting unit, arranged at the input of the coiling station, can deflect the metal strip toward a coiling mandrel.

Generally, the inspection table is provided with gripping means that allow to turn the strip specimens over in order to inspect the other face as well.

Furthermore, after the inspection on the inspection table, the strip specimens are conveyed toward a shears that reduces them to pieces before they are collected by gravity in a waste tub or cart.

The above-described solutions have advantages over a separate off-line inspection: short access time and fast inspection, use of only one specimen of the strip and therefore no need to remove an entire coil from the material flow. They do, however, have the drawbacks of using an orienting system or deflector.

AIMS OF THE INVENTION

The present invention aims to allow a rapid and inexpensive inspection of metal strips rolled in a continuously-working rolling installation, including the coiling station.

The invention also aims to produce a simple and reliable installation for performing this inspection.

The invention also aims to provide an installation that can be inserted into an existing line, where there is very little space available lengthwise.

MAIN CHARACTERISTIC FEATURES OF THE INVENTION

A first aspect of the present invention relates to a method for coiling and on-line inspection of a continuously-rolled metal strip, comprising a step for continuous coiling on at least one mandrel of a coiling station, preferably of the carousel type, characterized by at least the following steps:

- the strip is cut by a shears situated before the coiling, advances over a certain length on an insertion table so as to at least partially cover the latter, and is cut a second time by the shears so as to obtain a specimen;
- the coiling of the coil on the mandrel is completed and the coil is evacuated from the coiling station;
- in parallel, the insertion table bearing the specimen is moved parallel to the rolling-coiling line until it is in the extension of an inspection line comprising an inspection table;
- the specimen is inspected on the inspection table in order to detect faults;
- once the specimen has left the insertion table, the latter is repositioned in the rolling-coiling line, to allow a new coil to be coiled.

According to preferred embodiments of the invention, the method comprises one or a suitable combination of the following steps:

- at the level of the inspection table, the strip specimen is inspected on a first face, then turned over and inspected on its second face;
- after inspection, the specimen is conveyed from the inspection table to an evacuation table, at the end of which is a second shears that cuts the specimen into pieces which are then sent to a waste tub or similar member.

A second aspect of the present invention relates to an installation for coiling and on-line inspection of a continuously-rolled metal strip, comprising, downstream from the last rolling stand, a first shears, a coiling station on at least one mandrel and an inspection table for detecting faults on at least one face of a specimen of the strip, characterized in that the inspection table is part of a separate, so-called inspection line, parallel to the rolling-coiling line, and in that the installation further comprises an insertion table, initially situated between the shears and the coiling station in the rolling-coiling line and able to be moved from that line toward the inspection line via a conveyor, the insertion table allowing to transport, toward the inspection table, a strip specimen obtained in a strip tail using said shears by two successive cuts of the strip to obtain a predetermined length of specimen corresponding at least partially to the length of the insertion table.

Advantageously, the coiling station is a carousel station.

Also advantageously, the installation comprises, at the level of the inspection table, gripping means with claws that allow to turn the specimen over, in order to inspect the other face thereof.

Still advantageously, in the inspection line, the inspection table is extended by an evacuation table, at the end of which is a second shears for cutting the specimen into pieces, as well as a waste tub or similar member.

DETAILED DESCRIPTION OF THE INVENTION

Figure 1:
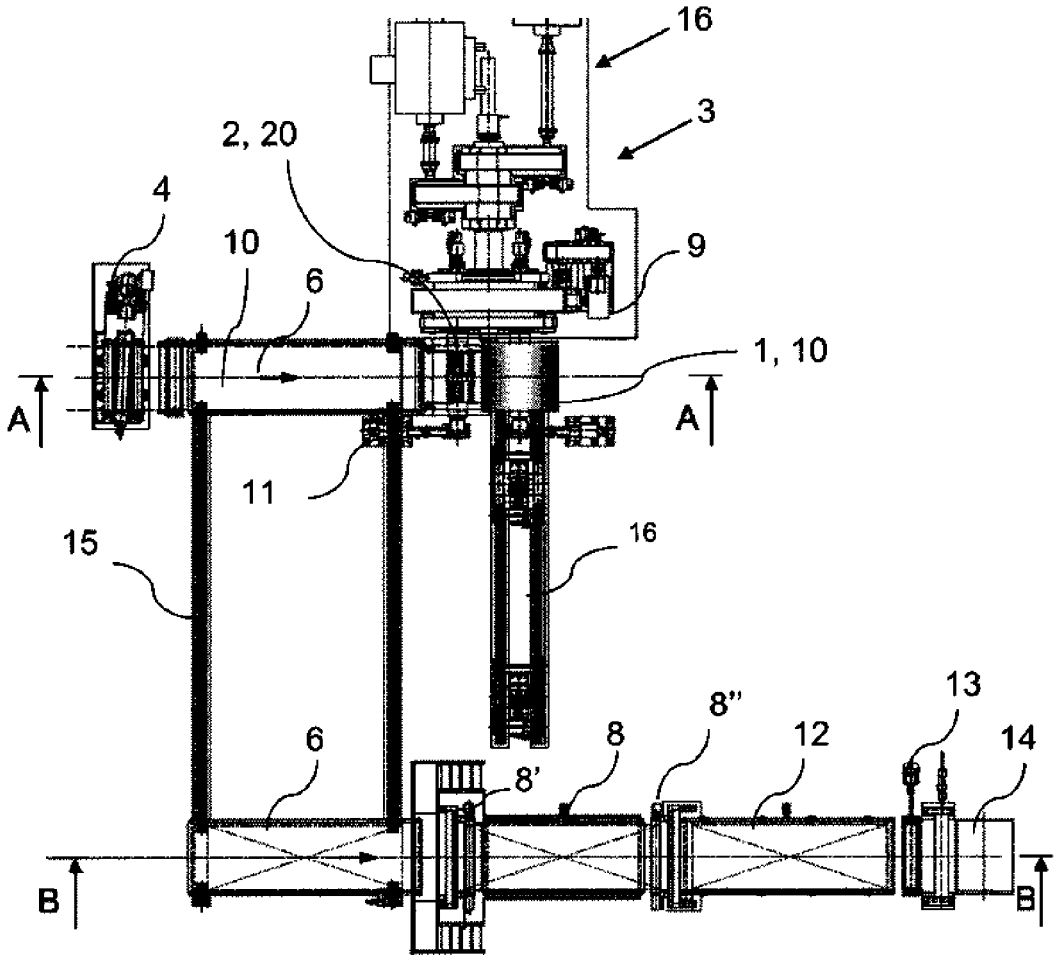
FIG. 1 shows a planar view of the carousel coiling station coupled with an inspection table according to one preferred embodiment of the present invention.
Figure 2:
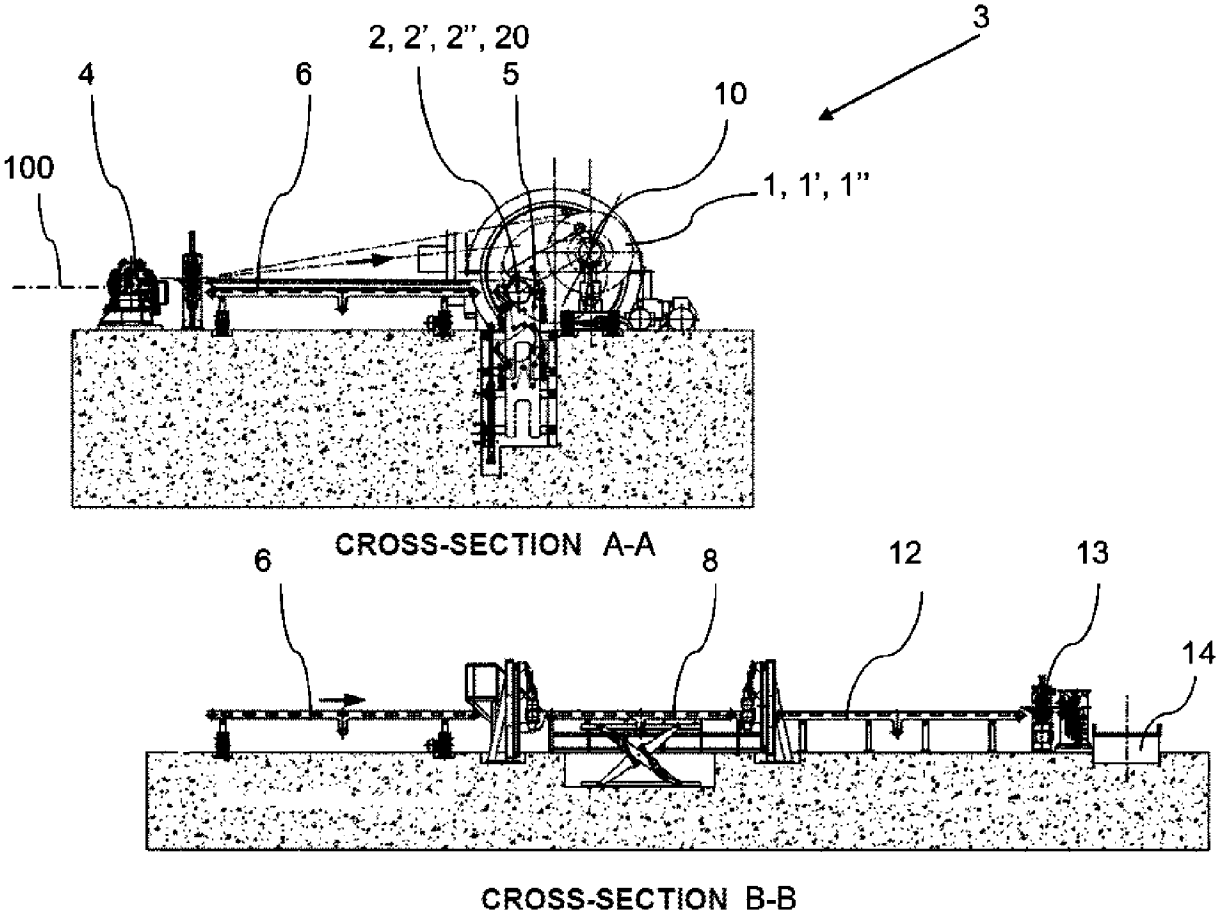
FIG. 2 shows two longitudinal cross-sectional views AA and BB, respectively, of the carousel coiling station according to FIG. 1.

One preferred embodiment of the installation according to the invention is shown in FIGS. 1 and 2.

The installation successively comprises, at the output of the last stand of the tandem rolling mill, in the motion direction of the metal strip (passing line 100):

- a first shears 4 allowing to obtain a strip specimen;
- an insertion table 6;
- a conveyor 15 allowing to move the insertion table 6 parallel to itself, outside the continuous rolling-coiling line;
- in a direction parallel to the continuous rolling-coiling line, successively, an inspection table 8; and
- means 8', 8" for gripping the strip specimen, in order to turn it over;
- an evacuation table 12;
- a second shears 13;
- a waste tub 14;
- in the continuous rolling-coiling line, a carousel 3 equipped with a first upper right mandrel 10 for making a coil 1, 1', 1", etc., provided with a mandrel-nose holder 9, a second lower left mandrel 20 for making a coil 2, 2', 2", etc., provided with a mandrel-nose holder 11 and a belt winder 5 for priming the winding on the mandrel 20;
- means 16 for evacuating the completed coils 1, 1', 1", etc.

The sequence of operations performed on this installation as described below. The order in which the operations are described below is not necessarily (always) chronological. Some operations may take place in parallel and be simultaneous.

Step 1

First of all, the progression speed of the strip and the rotation speed of the upper right mandrel 10 are decreased.

The strip of coil "no. 1" 1 (on the upper right mandrel 10) is cut a first time at the first shears 4, which generates a strip tail of coil 1 that will be coiled.

The strip advances another Y meters on the insertion table 6 before it is cut again by the shears 4, in order to obtain a specimen that covers all or part of the length of the insertion table 6.

The conveyor 15 moves the insertion table 6 with the specimen parallel to itself and the rolling-coiling line, until it is positioned along the inspection line, facing the inspection table 8. At that time, the progression of the strip is completely stopped. In the meantime, coil 1 is completely coiled.

The mandrel-nose holder 9, supporting the right mandrel 10, is evacuated. Coil "No. 1" 1 is then removed from the right mandrel 10 and evacuated with evacuation means 16.

The cut specimen advances on the inspection table 8 and the first face of the specimen is inspected. The ends of the specimen are gripped by gripping means 8', 8" and the sample is turned over (not shown). The other face of the specimen is inspected. The ends of the specimen are "ungripped". The specimen advances on the evacuation table 12, at the end of which a shears 13 cuts the specimen into pieces, which are next oriented toward a tub or waste car 14.

Step 2

Once the specimen has passed over the inspection table 8 and the insertion table 6 is freed, the latter is sent back in the other direction by the conveyor 15, until it is back in its place in the rolling-coiling line.

The head of the following strip advances onto the insertion table 6 as far as the coiling carousel 3 and coil "no. 2" 2 begins to be coiled on the lower left mandrel 20. Once several turns have been coiled, the belt winder 5 used to prime the winding of the strip is evacuated. The coiling speed increases.

The mandrel-nose holder 11, supporting the left mandrel 20, is evacuated and the coiling continues. During said coiling, the carousel 3 rotates by 180° clockwise.

Once the rotation of the carousel 3 is complete, the mandrel-nose holder 9 positions itself to support the new upper right mandrel 10. The coiling of the new coil "no. 2" 1' therefore continues on the new upper right mandrel 10.

The mandrel-nose holder 11 positions itself to support the new lower left mandrel 20. The belt winder 5 used to prime the winding of the strip is placed in the operating position.

Step 3

The progression speed of the strip and the rotation speed of the upper right mandrel 10 are decreased.

The strip from coil "no. 2" 1' is cut for a first time at the shears 4, which generates a strip tail of coil 1' that will be coiled. The strip advances another Y meters on the insertion table 6 before it is cut again by the shears 4, in order to obtain a specimen that covers the entire length of the insertion table 6. The inspection is then achieved as above. The coiling of coil "no. 2" is completed and the coil is evacuated. Once the insertion table is returned to the rolling-coiling line, it will be possible to coil a coil "no. 3" 2' on the lower left mandrel 10. Once several turns have been coiled, the belt winder 5 is evacuated. The coiling speed increases, and so forth.

The invention claimed is:

1. An installation for coiling and on-line inspection of a continuously-rolled metal strip to be coiled, comprising, downstream from a last rolling stand, in a main line, a first shears (4) for successively cutting the strip a first time and a second time after the strip has advanced over a certain length to obtain a strip specimen cut in a strip tail and having a predetermined length, a coiling station (3) having at least one coiling mandrel (10, 20) for coiling the strip, and an inspection table (8) for detecting faults on at least one of the faces of the strip specimen, wherein the inspection table (8) is part of a separate, inspection line, and parallel to the main line, and wherein the installation further comprises an insertion table (6), initially situated between the shears (4) and the coiling station (3) in the main line and able to be moved by means of a conveyor (15) from said main line toward the inspection line while being parallel to the main line so that the insertion table (6) allows to transport, toward the inspection table (8), the strip specimen cut in the strip tail and having a predetermined length, said predetermined length corresponding at least partially to the length of the insertion table (6).

2. The installation as in claim 1, wherein the coiling station (3) is a carousel station.

3. The installation as in claim 1 comprising, in association with the inspection table (8), gripping means with claws (8', 8") that allow to turn over the strip specimen, in order to inspect the other face thereof.

4. The installation as in claim 1, wherein, in the inspection line, the inspection table (8) is extended by an evacuation table (12), at the end of which is a second shears (13) for cutting the strip specimen into waste pieces, as well as a waste tub (14) or similar member to collect said waste pieces.

* * * * *